United States Patent [19]

Högel et al.

[11] 4,146,427

[45] Mar. 27, 1979

[54] HEAD BOX GUIDE BLOCK HAVING BORES AND TUBULAR INSERTS

[75] Inventors: Leo Högel, Berg; Wolfgang Trudel, Bad Waldsee; Siegfried Reutter, Gerbertshaus; Josef Schlegel, Tettnang, all of Fed. Rep. of Germany

[73] Assignee: Escher Wyss GmbH, Ravensburg, Fed. Rep. of Germany

[21] Appl. No.: 769,967

[22] Filed: Feb. 18, 1977

[30] Foreign Application Priority Data

Feb. 25, 1976 [CH] Switzerland ..... 2295/76

[51] Int. Cl.[2] ..... D21F 1/02

[52] U.S. Cl. ..... 162/343; 138/39

[58] Field of Search ..... 162/336, 343, 216; 251/118; 138/39, 44

[56] References Cited

U.S. PATENT DOCUMENTS

| | | | |
|---|---|---|---|
| 2,672,159 | 3/1954 | Walton | 138/44 |
| 3,098,787 | 7/1963 | Sieber | 162/343 X |
| 3,309,264 | 3/1967 | Parker et al. | 162/336 |
| 3,373,080 | 3/1968 | Appel et al. | 162/343 |
| 3,725,197 | 4/1973 | Dahl et al. | 162/343 |
| 3,769,155 | 10/1973 | Schiel | 162/343 |
| 3,921,672 | 11/1975 | Arnold | 138/44 X |

FOREIGN PATENT DOCUMENTS

| | | |
|---|---|---|
| 1236922 | 3/1967 | Fed. Rep. of Germany. |
| 1290797 | 3/1972 | Fed. Rep. of Germany. |

*Primary Examiner*—Richard V. Fisher

*Attorney, Agent, or Firm*—Kenyon & Kenyon, Reilly, Carr & Chapin

[57] ABSTRACT

The head box guide is formed of a metal block with cylindrical bores into which a pair of telescoping plastic inserts are fitted. Each pair of inserts are formed so as to define a stepped widening within the block. In addition, the inserts have terminal parts which are disposed outside of the bores and which are locked together in contiguous fashion so as to avoid any gaps. Also, a honeycomb connecting member rests on the downstream terminal parts of the inserts to form continuations of the flow passages.

13 Claims, 4 Drawing Figures

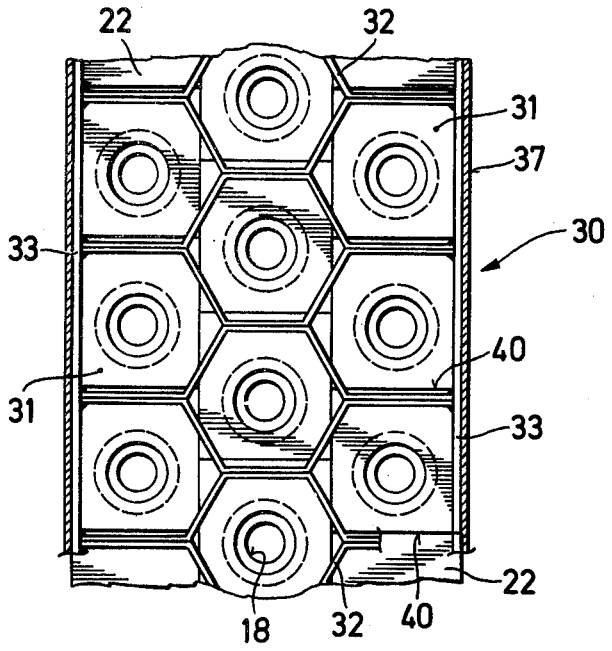
Fig. 2
Fig. 3
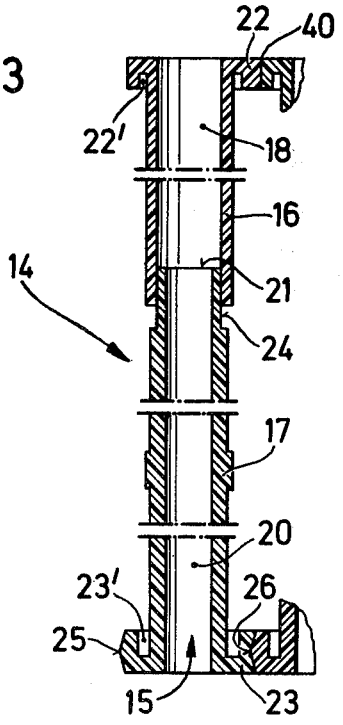
Fig. 4
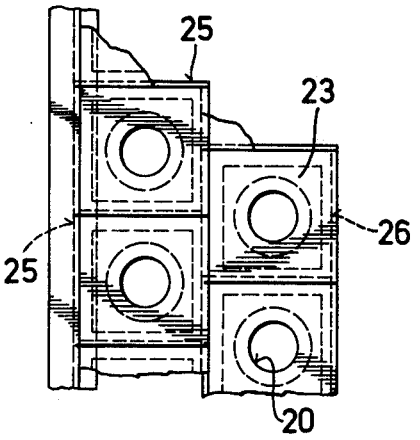

HEAD BOX GUIDE BLOCK HAVING BORES AND TUBULAR INSERTS

This invention relates to a head box guide for a paper making machine.

As is known, head boxes for paper making machines are provided with various types of guides which have a number of passages for guiding and uniformly distributing a flow of pulp or furnish or stock or the like, for example, onto a travelling wire or wires. Guides of this type are known, for example, U.S. Pat. No. 3,725,197 equivalent to Swiss Pat. No. 518,406, German Auslegesschrift 1,290,797 and German Patent Specification No. 1,236,922. In their simplest form, guides of this type are perforated plates with passages in a block. However, the passages must have a very smooth surface in order to prevent the fibers of material from sticking to the passage walls. In one advantageous construction, the passages are in the form of stepped diffusors and have different diameters along the length of the passages so as to form step widenings.

In many instances, difficulties arise in fabricating a large number of passages having a very high quality of surface texture, particularly in forming stepped bores and, more particularly, when the block in which the passages are formed is made of a hard metal such as a non-corrosive steel.

Accordingly, it is an object of the invention to provide a head box guide with passages which have a very smooth surface and which can be readily fabricated.

It is another object of the invention to provide a head box guide with passages of very smooth surface texture in blocks which are difficult to machine.

It is another object of the invention to provide a head box guide with passages which can be varied in shape.

Briefly, the invention provides a head box guide for a paper making machine comprising a block having a plurality of parallel cylindrical bores of constant diameter and at least one tubular insert in each respective bore for forming a flow passage of predetermined cross-sectional shape for a flow of stock.

The bore (i.e. passages or orifices) in the block need only be made to reduced standards of accuracy and surface texture. That is, the bores are inexpensive to produce since the inserts provide the required accuracy and surface texture for the flow passages. In addition, the inserts are fitted so as to be replaceable. Consequently, passages of different shapes and cross sections can be formed in the block as required.

Advantageously, the block is made of metal and particularly a metal of high strength material so as to supply a support function in the top box. As a result, the overall head box can be simplified. In addition, the inserts can be made of plastics. Such plastic inserts can be produced readily with a very smooth surface. Also, such inserts are very inexpensive to produce since they can be easily fabricated, for example, by injection molding. Further stresses are transferred to the block so that the inserts themselves do not have to be very strong.

Each bore may be provided with a pair of inserts which are disposed in coaxial relation with passages of different diameters so as to form a stepped widening within the block. By subdividing an insert into at least two component parts, difficulties caused by the fact that plastics and metal have different heat expansions can be obviated. Further, fabrication can be carried out at lower standards of accuracy since any deviations in length can be taken up at a junction between the components. Further, each of the components can have a simple, cylindrical or slightly conical passage which can be produced more simply than a stepped passage having a number of diameters.

Preferably, the insert components are disposed in telescoping relation. That is, the component having the smaller diameter passage is provided at the downstream end with a reduced outside surface which is introduced into the passage of the adjacent component. This feature has the advantage that the two components of the insert are free to expand relative to one another, the space between the components being protected against any accumulations of fibers.

Further, the components of each insert can have terminal parts of a cross section such that the adjacent terminal parts are engaged with each other in a contiguous relationship, i.e. in a gapless relation. This feature provides a continuous surface at the end of each of the bores in the block, which surface covers the corresponding end faces of the block and prevents fibers from sticking thereon.

Each terminal part can be formed with at least one of a lateral projection and a lateral recess so as to be releaseably received in a corresponding lateral recess or projection of an adjacent terminal part. In this way, the terminal parts of adjacent inserts are retained with respect to each other. In such a case, it is sufficient if the terminal parts located at the periphery of the block are retained in some fashion since the centrally located inserts are retained by the adjacent inserts. This also simplifies assembly as the various insert components can be easily introduced into the bores and their terminal parts snapped in between adjacent terminal parts.

In addition, a honeycombed connecting member is disposed at an output end of the inserts. This connecting member has a plurality of apertures which form a continuation of the flow passages. The honeycombed connecting member can be made, for example of thin metal strips which are soldered together. As such, a simple means is provided for forming the final stage of a multistage or stepped diffusor from which the flow can issue into a nozzle passage of the head box. The connecting member 30 can rest on the terminal parts of the downstream components of the inserts and can serve to retain these components in the block. Thus, two functions are provided. First, the downstream components of the inserts are secured in place in a simple manner so as to be prevented from moving out of the block, for example by the flow of pulp. The second function resides in the fact that the metal parts of the connecting member can cut into the plastic inserts. As a result, gaps which might otherwise occur between the inserts and the connecting member into which the fibers of the pulp might flow and become stuck are obviated.

These and other objects and advantages of the invention will become more apparent from the following detailed description and appended claims taken in conjunction with the accompanying drawings in which:

FIG. 2 illustrates a partial view taken along line II—II of FIG. 2;

FIG. 3 illustrates an enlarged cross sectional view of an insert in accordance with the invention; and FIG. 4 illustrates a partial elevational view taken in the direction of the arrow IV of FIG. 1.

Figure 1:
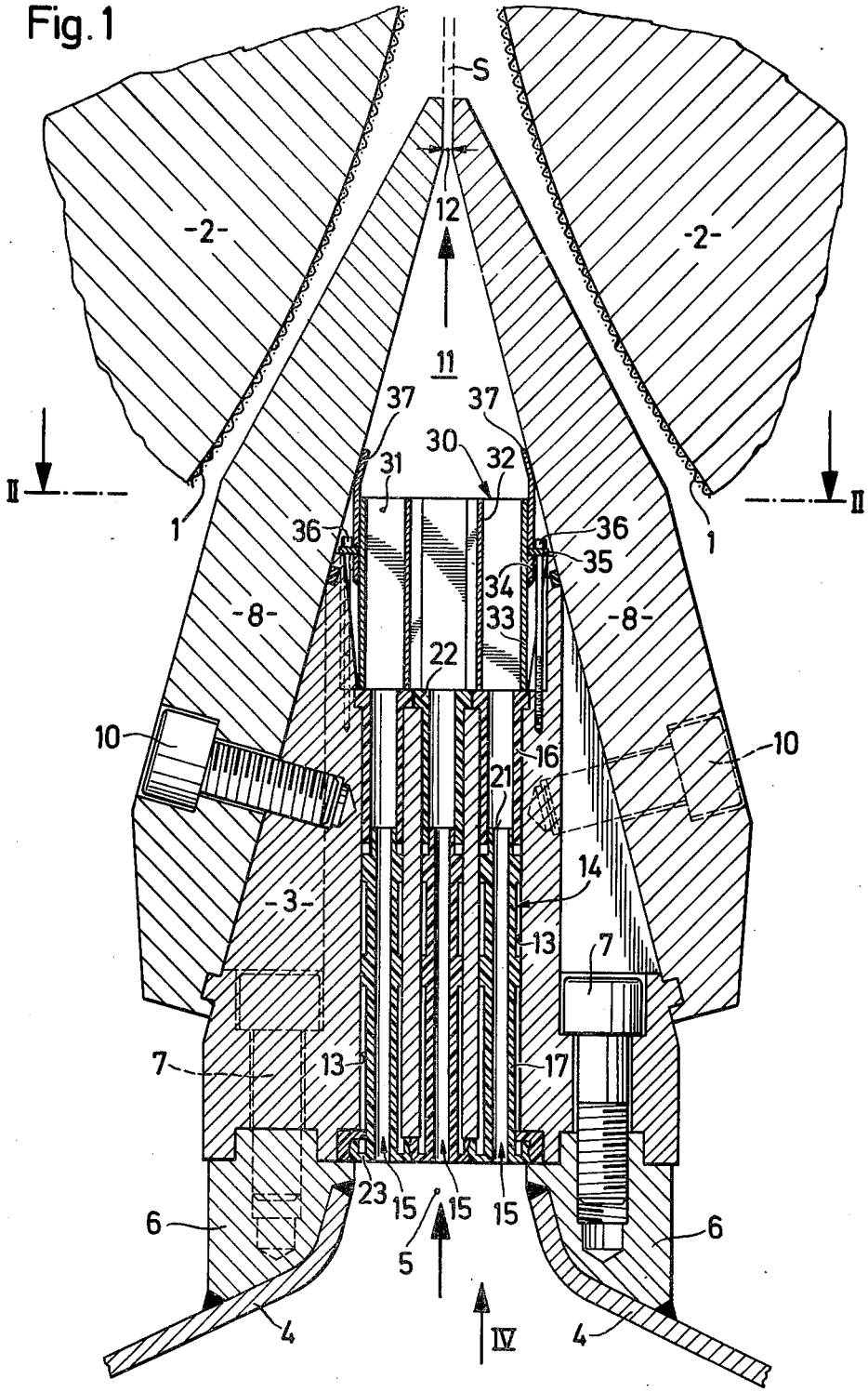
FIG. 1 illustrates a cross sectional view of an exit zone of a head box having a guide in accordance with the invention.

Referring to FIG. 1, a head box has an output or delivery end which serves to form a stream S of pulp or stock or furnish or the like which is directed between two wires 1 as is known. The wires 1 are trained over wire cylinders 2, for example as is known in a double wire machine. The head box includes a nozzle block 3 made of high strength metal such as a non-corrosive steel, which closes the edges 4 of a distribution tube formed with an aperture 5 as is known. As shown, the edges 4 have connecting wedges or the like 6 to which the block 3 is secured by bolts 7.

As shown, the block 3 also has lips 8 secured thereto by bolts 10 in order to define a nozzle passage 11 and a pulp exit gap 12.

In addition, the block is formed with a plurality of parallel bores, passages or orifices 13 which are cylindrical in cross-sectional shape and which are the same diameter throughout their length. Since the surface texture of these bores 13 does not have to be of very high quality, the bores 13 can be fabricated in a relatively cheap manner in the kind of strong and tough material, such as non-corrosive steel, necessary to transmit forces between the tube edges 4.

As shown, each of the bores 13 receives an insert 14 which is formed with passages 15 of predetermined cross-sectional shape. As shown in FIGS. 1 and 3, a pair of inserts 16, 17 are pushed into each of the bores 13 from the opposite ends. As shown in FIG. 3, the component inserts 16, 17 have passages 18, 20, respectively, which differ in diameter from one another and which cooperate with one another to form a step widening 21. The two passages 18, 20 thus form a passage 15 having the shape of a stepped or multi-stage diffusor.

Referring to FIGS. 2 to 4, each of the component inserts 16, 17 has a terminal part 22, 23. As shown, the terminal parts 22, 23 have a cross section such that the terminal parts 22, 23 of the inserts of adjacent bores 13 can be disposed in contiguous relation, i.e. in gapless relation, with one another. In the present case, the terminal parts 22, 23 are rectangular with the length of the side of the rectangle corresponding to the space between adjacent bores 13.

In order to allow the component inserts to expand in the bores 13 when heated, and also in order to increase the limits of permissible tolerances in manufacture, the component part insert 17 which has the small diameter passage 20, has a reduced outside surface 24 at the downstream end for introduction into the passage 18 of the other component part insert 16. Thus, a gapless transition is provided between the passages 18, 20, however, the inserts 16, 17 are movable with relation to each other coaxially.

As is apparent from FIGS. 3 and 4, each terminal part 23 is formed on two sides with projections 25 bounded by inclined surfaces. On the opposite sides, the terminal parts 23 are formed with lateral recesses 26 of a shape matching the lateral projections 25. The projections 25 are adapted to engage releaseably in the recesses 26 in order to lock the terminal parts 23 of adjacent inserts relative to one another.

As shown in FIGS. 1 and 2, the terminal parts 23 and, thus, the component insert 17 disposed at the peripheral edges of the block 3, are retained by the ledges 6. The terminal parts 23 in the centrally located rows are secured by the projections 25 and recesses 26 of the terminal parts 23 of the peripheral rows. During assembly, the various terminal parts 23 can be readily slid in between the adjacent terminal parts with the projections snapping into the recesses due to the resilience of the plastic material.

As shown in FIGS. 1 and 2, the output ends of the passages 15 as embodied by the terminal parts 22 are followed by a honeycomb connecting member 30. This member 30 is formed with passages 31 which continue the passages 15 through the inserts. The connecting member 30 is formed of metal angle members 32 which are interconnected, for example by soldering. These members 32 are secured to sidewalls 33 which can be made of metal. As shown in FIG. 1, ledges 34 are secured to the sidewalls 33 and securing members 35 abutted against the ledges 34 by screws 36 which are threaded into the block 3. In addition, resilient cover plates 37 are secured to the walls 33 on both sides of the member 30 in order to guide the flow of pulp laterally between lips 8 and the member 30.

The connecting member 30 also serves to retain the terminal parts 22 of the component insert 16 on the block 3. Further, the metal angle members 32 can cut into the plastics used for the terminal parts 22, thus completely precluding any risk of the formation of edges to which fibers from the flow of pulp might stick.

The terminal parts 22 of the downstream component inserts 16 are disposed in asymmetric relation as shown in FIG. 2. Thus, the angle members 32 of the connecting member 30 cannot coincide with the junctions 40 between adjacent terminal parts 22. This avoids any uncertainty in the cutting-in effect of the members 32 into the terminal parts 22 as mentioned above.

As shown in FIG. 3, the terminal parts 22, 23 are each formed in the region of their throat near the block 3 with an annular recess 22', 23'. As shown in FIG. 1, these annular recesses are disposed in facing relation to the block 3 in order to increase the lateral resilience of the terminal parts 22, 23 so that the parts can be pressed together when assembled. This facilitates the engagement of the projections 25 in the recesses 26 during assembly. Also, the recesses 22', 23' allow the take-up of any burr or flashing at the ends of the corresponding bore 13. Thus, the bores 13 do not have to be deburred and the machine costs for the block 3 are thus reduced.

The projections 25 and recesses 26 are illustrated only on the component insert 17 but can, of course, also be formed on the terminal parts 22 of the component insert 16.

At present, it appears to be advantageous to make the component inserts of plastics. However, these component inserts can, of course, be made from some other material depending upon operating conditions. For example, the inserts may be made of a readily machineable metal, glass or the like. In this event, the passages 18, 20 need not be cylindrical as shown, but may be of conical or other appropriate shape.

What is claimed is:

1. A head box guide for a paper making machine comprising a distribution tube for a flow of stock;

a block mounted on said tube, said block having a plurality of parallel cylindrical bores of constant diameter extending therethrough from said tube, and at least one tubular insert in each respective bore for forming a stepped flow passage of predetermined cross-sectional shape for a flow of stock.

2. A head box guide as set forth in claim 1 wherein said block is made of metal.

3. A head box guide as set forth in claim 2 wherein each insert is made of plastics.

4. A head box guide as set forth in claim 3 which has a pair of said inserts in each respective bore, each said pair of inserts being disposed in coaxial relation and having passages of different diameters to form a stepped widening within each bore.

5. A head box guide as set forth in claim 4 wherein said inserts of each said pair of inserts are disposed in telescoping relation.

6. A head box guide as set forth in claim 4 wherein each insert of said pair of inserts has a terminal part disposed outside a respective bore, each said terminal part being disposed in contiguous engagement with an adjacent terminal part.

7. A head box guide as set forth in claim 6 wherein each terminal part has at least one of a lateral projection and lateral recess for releaseably receiving a selective one of a lateral recess and lateral projection of an adjacent terminal part.

8. A head box guide as set forth in claim 6 wherein each terminal part has an annular recess facing said block.

9. A head box guide as set forth in claim 6 which further comprises a honeycomb connecting member resting on said terminal parts at an output end of each insert of said pair of inserts, said connecting member having a plurality of apertures forming a continuation of said flow passages.

10. A head box guide as set forth in claim 1 which further comprises a honeycomb connecting member disposed at an output end of said inserts, said connecting member having a plurality of apertures forming a continuation of said flow passages.

11. A head box guide comprising a distribution tube for a flow of stock;

a nozzle block of high strength metal mounted on said tube, said block having a plurality of parallel cylindrical bores of constant diameter extending therethrough from said tube;

a pair of plastic inserts slidably disposed in each said bore, each said pair of inserts being disposed in telescoping relation with each other and having passages of different diameters to form a stepped widening within each bore, each insert of said pair of inserts having a terminal part outside a respective bore and releaseably engaged with an adjacent terminal part in contiguous relation; and a honeycomb connecting member resting on said terminal parts at an output end of said inserts, said connecting member having a plurality of apertures forming a continuation of said flow passages.

12. A head box guide for a paper making machine comprising a metal block having a plurality of parallel cylindrical bores of constant diameter, and a pair of tubular plastics insert in each respective bore, each said pair of inserts being disposed in coaxial relation and having passages of different diameters to form a stepped widening within each bore for forming a stepped flow passage of predetermined cross-sectional shape for a flow of stock, each insert of said pair of inserts having a terminal part disposed outside a respective bore, each said terminal part being disposed in contiguous engagement with an adjacent terminal part.

13. A head box guide for a paper making machine comprising a block having a plurality of parallel cylindrical bores of constant diameter, at least one tubular insert in each respective bore for forming a stepped flow passage of predetermined cross-sectional shape for a flow of stock, and a honeycomb connecting member disposed at an output end of said inserts, said connecting member having a plurality of apertures forming a continuation of said flow passages.

* * * * *

UNITED STATES PATENT AND TRADEMARK OFFICE

CERTIFICATE OF CORRECTION

PATENT NO. : 4,146,427
DATED : March 27, 1979
INVENTOR(S) : Leo Hogel et al

It is certified that error appears in the above-identified patent and that said Letters Patent are hereby corrected as shown below:

Column 1, line 12, after "example" insert --from--

Signed and Sealed this

*Twenty-fifth* Day of *September 1979*

[SEAL]

*Attest:*

*Attesting Officer*

LUTRELLE F. PARKER
*Acting Commissioner of Patents and Trademarks*